United States Patent [19]

Ray

[11] 4,221,592

[45] * Sep. 9, 1980

[54] GLASSY ALLOYS WHICH INCLUDE IRON GROUP ELEMENTS AND BORON

[75] Inventor: Ranjan Ray, Morristown, N.J.

[73] Assignee: Allied Chemical Corporation, Morris Township, Morris County, N.J.

[ * ] Notice: The portion of the term of this patent subsequent to Jan. 10, 1996, has been disclaimed.

[21] Appl. No.: 830,232

[22] Filed: Sep. 2, 1977

Related U.S. Application Data

[63] Continuation-in-part of Ser. No. 590,532, Jun. 26, 1975, Pat. No. 4,067,732.

[51] Int. Cl.[2] ..... C22C 19/00; C22C 38/00

[52] U.S. Cl. ..... 75/122; 75/123 B; 75/123 K; 75/134 F; 75/170

[58] Field of Search ..... 75/122, 123 K, 134 F, 75/170, 123 C, 123 B

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 75/122 |
| 4,056,411 | 11/1977 | Chen et al. | 148/108 |
| 4,067,732 | 1/1978 | Ray | 75/126 P |
| 4,152,146 | 5/1979 | Freilich et al. | 75/123 B |

*Primary Examiner*—R. Dean

*Attorney, Agent, or Firm*—Ernest D. Buff; Gerhard H. Fuchs

[57] ABSTRACT

Iron group-boron base glassy alloys are disclosed which evidence improved ultimate tensile strengths, hardnesses and crystallization temperatures as compared with prior art glassy alloys. The alloys have the formula $$M_aM'_{b}{}''_{c}B_d$$

where M is one iron group element (iron, cobalt or nickel), M′ is at least one of the two remaining iron group elements, M″ is at least one element of vanadium, manganese, molybdenum, tungsten, niobium and tantalum, "a" ranges from about 40 to 87 atom percent, "b" ranges from 0 to about 47 atom percent, "c" ranges from 0 to about 20 atom percent and "d" ranges from about 26 to 28 atom percent, with the proviso that "b" and "c" cannot both be zero simultaneously.

7 Claims, No Drawings

GLASSY ALLOYS WHICH INCLUDE IRON GROUP ELEMENTS AND BORON

CROSS-REFERENCE TO RELATED APPLICATION

This is a continuation-in-part of application Ser. No. 590,532, filed June 26, 1975 now U.S. Pat. No. 4,067,732.

BACKGROUND OF THE INVENTION

1. Field of the Invention

The invention is concerned with glassy alloys and, more particularly, with glassy alloys which include the iron group elements (iron, cobalt and nickel) plus boron.

2. Description of the Prior Art

Novel amorphous (glassy) metal alloys have been disclosed and claimed by H. S. Chen and D. E. Polk in U.S. Pat. No. 3,856,513, issued Dec. 24, 1974. These glassy alloys have the formula $M_aY_bZ_c$, where M is at least one metal selected from the group consisting of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent. These glassy alloys have been found suitable for a wide variety of applications, including ribbon, sheet, wire, powder, etc. Glassy alloys are also disclosed and claimed having the formula $T_iX_j$, where T is at least one transition metal, X is at least one element selected from the group consisting of aluminum, antimony, beryllium, boron, germanium, carbon, indium, phosphorus, silicon and tin, "i" ranges from about 70 to 87 atom percent and "j" ranges from about 13 to 30 atom percent. These glassy alloys have been found suitable for wire applications.

At the time these glassy alloys were discovered, they evidenced mechanical properties that were superior to then-known polycrystalline alloys. Such superior mechanical properties included ultimate tensile strengths up to 350,000 psi, hardness values of about 600 to about 830 $Kg/mm^2$ and good ductility. Nevertheless, new applications requiring improved magnetic, physical and mechanical properties and higher thermal stability have necessitated efforts to develop further specific compositions.

SUMMARY OF THE INVENTION

In accordance with the invention, iron group, boron base glassy alloys are provided which evidence improved ultimate tensile strengths, hardnesses and crystallization temperatures. These glassy alloys also have desirable magnetic properties. The glassy alloys of the invention consist essentially of the composition $$M_aM'_bM''_cB_d$$

where M is one element selected from the group consisting of iron, cobalt and nickel, M' is one or two elements selected from the group consisting of iron, cobalt and nickel other than M, M'' is at least one element of vanadium, manganese, molybdenum, tungsten, niobium and tantalum, "a" ranges from about 40 to 87 atom percent, "b" ranges from 0 to about 47 atom percent, "c" ranges from 0 to about 20 atom percent and "d" ranges from about 13 to 28 atom percent, with the proviso that "b" and "c" cannot both be zero simultaneously.

Restated, the glassy alloys of the invention consist essentially of about 52 to 87 atom percent of at least one element selected from the group consisting of iron, cobalt and nickel, with the proviso that at least one of said elements is present in an amount of at least about 40 atom percent, 0 to about 20 atom percent of at least one element selected from the group consisting of vanadium, manganese, molybdenum, tungsten, niobium and tantalum and about 13 to 28 atom percent boron.

The alloys of this invention are primarily glassy, and preferably substantially totally glassy, as determined by X-ray diffraction.

The glassy alloys in accordance with the invention are fabricated by a process which comprises forming a melt of the desired composition and quenching at a rate of at least about $10^{5°}$ C./sec by casting molten alloy onto a chill wheel or into a quench fluid. Improved physical and mechanical properties, together with increasing glassiness, are achieved by casting the molten alloy onto a chill wheel in a partial vacuum having an absolute pressure of less than abut 5.5 cm of Hg.

DETAILED DESCRIPTION OF THE INVENTION

There are many applications which require that any alloy have, inter alia, a high ultimate tensile strength, high thermal stability and ease of fabricability. For example, metal ribbons used in razor blade applications usually undergo a heat treatment of about 370° C. for about 30 min to bond an applied coating of polytetrafluoroethylene to the metal. Likewise, metal strands used as tire cord undergo a heat treatment of about 160° to 170° C. for about 1 hr to bond tire rubber to the metal.

When crystalline alloys are employed, phase changes can occur during heat treatment that tend to degrade the physical and mechanical properties. Likewise, when glassy alloys are employed, a complete or partial transformation from the glassy state to an equilibrium or a metastable crystalline state can occur during heat treatment. As with inorganic oxide glasses, such a transformation often degrades physical and mechanical properties such as ductility, tensile strength, etc.

The thermal stability of a glassy alloy is an important property in certain applications. Thermal stability is characterized by the time-temperature-transformation behavior of an alloy, and may be determined in part by DTA (differential thermal analysis). As considered here, relative thermal stability is also indicated by the retention of ductility in bending after thermal treatment. Alloys with similar crystallization behavior as observed by DTA may exhibit different embrittlement behavior upon exposure to the same heat treatment cycle. By DTA measurement, crystallization temperatures, $T_c$, can be accurately determined by slowly heating a glassy alloy (at about 20° to 50° C./min) and noting whether excess heat is evolved over a limited temperature range (crystallization temperature) or whether excess heat is absorbed over a particular temperature range (glass transition temperature). In general, the glass transition temperature $T_g$ is near the lowest, or first, crystallization temperature $T_{c1}$, and, by convention, is the temperature at which the viscosity ranges from about $10^{13}$ to $10^{14}$ poise.

Most glassy alloy compositions containing iron, nickel, cobalt and chromium which include phosphorus, among other metalloids, evidence ultimate tensile strengths of about 265,000 to 350,000 psi and crystallization temperatures of about 400° to 460° C. For example, the properties of several prior art glassy alloys are shown in Table I:

TABLE I

| Composition (atom percent) | Ultimate Tensile Strength (psi) | Hardness ($Kg/mm^2$) | Crystallization Temperature (°C.) |
|---|---|---|---|
| $Fe_{76}P_{16}C_4Si_2Al_2$ | 310,000 | | 460 |
| $Fe_{30}Ni_{30}Co_{20}P_{13}B_5Si_2$ | 265,000 | | 415 |
| $Fe_{40}Ni_{40}P_{14}B_6$ | 320,000 | | |
| $Ni_{49}Fe_{29}P_{14}B_6Si_2$ | 296,000 | 698 | |
| $Ni_{48}Fe_{29}P_{14}B_6Al_3$ | | 743 | |

The thermal stability of these compositions in the temperature range of about 200° to 350° C. is low, as shown by a tendency to embrittle after heat treating, for example, at 250° C. for 1 hr or 300° C. for 30 min or 330° C. for 5 min. Such heat treatments are required in certain specific applications, such as curing a coating of polytetrafluoroethylene on razor blade edges or bonding tire rubber to metal wire strands.

In accordance with the invention, iron group-boron base glassy alloys have improved ultimate tensile strengths, hardnesses and crystallization temperatures. These glassy alloys consist essentially of the compositon $$M_aM'_bM''_cB_d$$

where M is one iron group element (iron, cobalt or nickel), M' is at least one of the remaining two iron group elements, M'' is at least one element of vanadium, manganese, molybdenum, tungsten, niobium and tantalum, "a" ranges from about 40 to 87 atom percent, "b" ranges from 0 to about 47 atom percent, "c" ranges from 0 to about 20 atom percent and "d" ranges from about 13 to 28 atom percent, with the proviso that "b" and "c" cannot both be zero simultaneously. Examples of glassy alloy compositions of the invention include $Fe_{69}Co_{18}B_{13}$, $Fe_{40}Co_{40}B_{20}$, $Fe_{67}Ni_{19}B_{14}$, $Fe_{40}Ni_{40}B_{20}$, $Co_{70}Fe_{10}B_{20}$, $Ni_{50}Fe_{30}B_{20}$, $Fe_{81}Co_3Ni_1B_{15}$, $Fe_{60}Mo_{20}B_{20}$, $Fe_{68}Mo_4B_{28}$, $Fe_{60}W_{20}B_{20}$, $Fe_{71}W_2B_{27}$, $Fe_{72}Nb_8B_{20}$, $Fe_{72}Ta_8B_{20}$, $Fe_{78}Mn_2B_{20}$, $Fe_{78}V_2B_{20}$, $Ni_{58}Mn_{20}B_{22}$ and $Ni_{65}V_{15}B_{20}$. The purity of all compositions is that found in normal commercial practice.

The glassy alloys of the invention typically evidence ultimate tensile strengths of at least about 370,000 psi, hardnesses of at least about 925 $Kg/mm^2$ and crystallization temperatures of at least about 370° C.

Preferred compositions having high tensile strengths, high hardnesses and high crystallization temperatures include compositions where M'' is molybdenum, tungsten, niobium and tantalum. Preferred molybdenum content ranges from about 0.4 to 18 atom percent, preferred tungsten content ranges from about 0.4 to 15 atom percent and preferred niobium and tantalum content each range from about 0.5 to 12 atom percent. Examples include $Fe_{70}Mo_2B_{28}$, $Fe_{66}Mo_{17}B_{17}$, $Fe_{71}W_2B_{27}$, $Fe_{67}W_{15}B_{18}$, $Fe_{72}Nb_8B_{20}$ and $Fe_{72}Ta_8B_{20}$.

Especially preferred compositions include molybdenum and tungsten, present in the amounts given above. Below about 0.4 atom percent, a substantial increase in hardness is not obtained. While above about 18 atom percent molybdenum or about 15 atom percent tungsten, increased hardness values and crystallization temperatures are obtained, the bend ductility of glassy ribbons of these compositions is reduced, necessitating a balancing of desired properties. The effect of tungsten on hardness and crystallization temperature is somewhat more pronounced than that of molybdenum. For example, tungsten provides a rate of increase in crystallization temperature of about 11° C. per atom percent, while the value for molybdenum is about 8° C. per atom percent. Similarly, tungsten provides a rate of increase in hardness of about 20 $Kg/mm^2$ per atom percent, while the value for molybdenum is about 12 $Kg/mm^2$ per atom percent.

The best combination of high strength, high hardness and high crystallization is achieved with alloys containing about 16 to 22 atom percent boron, plus about 14 to 18 atom percent molybdenum or about 10 to 14 atom percent tungsten. The alloys having compositions within these ranges evidence the following mechanical and thermal properties: ultimate tensile strengths of about 450,000 to 500,000 psi, hardnesses of about 1200 to 1400 $Kg/mm^2$ and crystallization temperatures of about 575° to 650° C. Examples of such preferred alloys include $Fe_{65}Mo_{17}B_{18}$, $Fe_{68.5}Mo_{15}B_{16.5}$, $Fe_{69}W_{13}B_{18}$ and $Fe_{71}Mo_{11}B_{18}$.

Glassy alloys having boron content of about 24 to 28 atom percent and about 1 to 6 atom percent of tungsten or molybdenum evidence high ultimate tensile strengths of about 450,000 to 510,000 psi and high hardnesses of about 1250 to 1350 $Kg/mm^2$ and accordingly are also preferred. Examples of such preferred alloys include $Fe_{70}Mo_2B_{28}$, $Fe_{71}W_2B_{27}$ and $Fe_{71}W_4B_{25}$.

Preferred compositions evidencing superior fabricability as filaments with smooth edges and surfaces with high mechanical strength include compositions where M'' is manganese and vanadium, each present in an amount of about 0.2 to 2 atom percent. Examples include $Fe_{78}Mn_2B_{20}$ and $Fe_{78}V_2B_{20}$.

Preferred glassy alloys having desirable magnetic properties depend on the specific application desired. For such compositions, "c" is preferably zero. For high saturation induction values, e.g., about 13 to 19 KGauss, it is desired that a relatively high amount of cobalt and/or iron be present. Examples include $Fe_{81}Co_3Ni_1B_{15}$ and $Fe_{69}Co_{18}B_{13}$. For low coercivities less than about 0.5 Oe, it is desired that a relatively high amount of nickel and/or iron be present. Examples include $Ni_{50}Fe_{32}B_{18}$ and $Fe_{50}Ni_{20}Co_{15}B_{15}$. Preferably, the boron content of such alloys ranges from about 13 to 22 atom percent for ease of fabricability. Examples include $Fe_{80}Co_5B_{15}$, $Fe_{70}Co_{10}B_{20}$, $Fe_{69}Co_{18}B_{13}$, $Fe_{40}Co_{40}B_{20}$, $Fe_{67}Ni_{19}B_{14}$, $Fe_{61}Ni_{25}B_{14}$, $Fe_{57}Ni_{29}B_{14}$, $Fe_{43}Ni_{43}B_{14}$, $Fe_{40}Ni_{40}B_{20}$, $Ni_{60}Fe_{22}B_{18}$, $Ni_{50}Fe_{32}B_{18}$, $Fe_{81}Co_3Ni_1B_{15}$, $Fe_{70}Ni_{7.5}Co_{7.5}B_{15}$, $Fe_{65}Ni_7Co_7B_{21}$ and $Fe_{50}Ni_{20}Co_{15}B_{15}$.

In all cases, iron is especially preferred as the iron group element, since it provides high saturation induction, low coercivity, high strength and high crystallization temperature, as well as being low cost, compared with cobalt and nickel.

The glassy alloys of the invention are formed by cooling a melt at a rate of at least about $10^5$° C./sec. A variety of techniques are available, as is now well-known in the art, for fabrication splat-quenched foil and rapid-quenched continuous ribbon, wire, strip, sheet, etc. Typically, a particular composition is selected, powders of the requisite elements (or of materials that decompose to form the elements, such as ferroboron, ferrochrome, etc.) in the desired proportions are melted and homogenized, and the molten alloy is rapidly quenched either on a chill surface, such as a rotating cooled cylinder, or in a suitable fluid medium, such as a chilled brine solution. The glassy alloys may be formed in air. However, superior mechanical properties are achieved by forming the glassy alloys of the invention in a partial vacuum with absolute pressure less than about 5.5 cm of Hg, and preferably about 100 μm to 1 cm of Hg.

The glassy alloys are at least primarily glassy, and preferably substantially totally glassy as measured by X-ray diffraction, since ductility is improved with increasing glassiness.

The glassy alloys of the present invention evidence superior fabricability, compared with prior art compositions. In addition to their improved resistance to embrittlement after heat treatment, the glassy alloys of the invention tend to be more oxidation and corrosion resistant than prior art compositions.

These compositions remain glassy at heat treating conditions under which phosphorus-containing glassy alloys tend to embrittle. Ribbons of these alloys find use in applications requiring relatively high thermal stability and increased mechanical strength.

EXAMPLES

Rapid melting and fabrication of amorphous strips of ribbons of uniform width and thickness from high melting (about 1100° to 1600° C.) reactive alloys was accomplished under vacuum. The application of vacuum minimized oxidation and contamination of the alloy during melting or squirting and also eliminated surface damage (blisters, bubbles, etc.) commonly observed in strips processed in air or inert gas at 1 atm. A copper cylinder was mounted vertically on the shaft of a vacuum rotary feedthrough and placed in a stainless steel vacuum chamber. The vacuum chamber was a cylinder flanged at two ends with two side ports and was connected to a diffusion pumping system. The copper cylinder was rotated by variable speed electric motor via the feedthrough. A crucible surrounded by an induction coil assembly was located above the rotating cylinder inside the chamber. An induction power supply was used to melt alloys contained in crucibles made of fused quartz, boron nitride, alumina, zirconia or beryllia. The amorphous ribbons were prepared by melting the alloy in a suitable nonreacting crucible and ejecting the melt by over-pressure of argon through an orifice in the bottom of the crucible onto the surface of the rotating (about 1500 to 2000 rpm) cylinder. The melting and squirting were carried out in a partial vacuum of about 100 μm, using an inert gas such as argon to adjust the vacuum pressure.

Using the vacuum-melt casting apparatus described above, a number of various glass-forming iron group-boron base alloys were chill cast as continuous ribbons having substantially uniform thickness and width. Typically, the thickness ranged from 0.001 to 0.003 inch and the width ranged from 0.03 to 0.12 inch. The ribbons were glassy, as determined by X-ray diffraction and DTA. Hardness (in Kg/mm$^2$) was measured by the diamond pyramid technique, using a Vickers-type indenter consisting of a diamond in the form of a square-based pyramid with an included angle of 136° between opposite faces. Tensile tests to determine ultimate tensile strength (in psi) were carried out using an Instron machine. The mechanical behavior of amorphous metal alloys having compositions in accordance with the invention was measured as a function of heat treatment. All alloys were fabricated by the process given above. The glassy ribbons of the alloys were all ductile in the as-quenched condition. The ribbons were bent end on end to form a loop. The diameter of the loop was gradually reduced between the anvils of a micrometer. The ribbons were considered ductile if they could be bent to a radius of curvature less than about 0.005 inch without fracture. If a ribbon fractured, it was considered to be brittle.

EXAMPLE 1

Alloys having high ultimate tensile strengths, high hardnesses and high crystallization temperature are given in Table II. These alloys are described by the general composition $M_{40-87}M'_{0-45}M''_{0-20}B_{13-28}$. Such alloys are useful in, for example, structural applications.

TABLE II

| Alloy Composition (atom percent) | Ultimate Tensile Strength (psi) | Hardness (Kg/mm$^2$) | Crystallization Temperature (°C.) |
|---|---|---|---|
| Iron Base | | | |
| $Fe_{78}Mn_2B_{20}$ | | 1048 | |
| $Fe_{78}V_2B_{20}$ | | 1097 | |
| $Fe_{78}Ni_8B_{14}$ | | 960 | 454 |
| $Fe_{75}W_7B_{18}$ | | 1370 | |
| $Fe_{75}Mo_7B_{18}$ | | 1170 | 540 |
| $Fe_{73}W_9B_{18}$ | 475,000 | 1300 | 575 |
| $Fe_{72}Nb_8B_{20}$ | | 1150 | 550 |
| $Fe_{72}Ta_8B_{20}$ | | 1225 | |
| $Fe_{71}W_2B_{27}$ | 480,000 | 1300 | 475 |
| $Fe_{71.56}Mo_{10.84}B_{17.6}$ | 490,000 | 1430 | |
| $Fe_{71}W_4B_{25}$ | 485,000 | 1280 | |
| $Fe_{70}W_8B_{22}$ | 430,000 | 1204 | |
| $Fe_{70}W_{13}B_{17}$ | 500,000 | 1450 | 625 |
| $Fe_{70}Ni_4Co_5B_{21}$ | | | 455 |
| $Fe_{70}Ni_{7.5}Co_{7.5}B_{15}$ | | | 435; 504 |
| $Fe_{70}Ni_{16}B_{14}$ | | 974 | 465 |
| $Fe_{70}Mo_2B_{28}$ | 505,000 | 1310 | 475 |
| $Fe_{70}Co_{10}B_{20}$ | | 1100 | 465 |
| $Fe_{69}W_{13}B_{18}$ | 500,000 | 1530 | 630 |
| $Fe_{68.5}Mo_{15}B_{16.5}$ | 485,000 | 1260 | 600 |
| $Fe_{68}Mo_4B_{28}$ | | 1331 | 485 |
| $Fe_{67}W_{15}B_{18}$ | | 1450 | 640 |
| $Fe_{67}Mo_7B_{26}$ | | 1354 | 510 |
| $Fe_{67}Ni_{19}B_{14}$ | | 946 | 463 |
| $Fe_{66}Mo_{17}B_{17}$ | 475,000 | 1300 | 620 |
| $Fe_{65}W_{17}B_{18}$ | | 1500 | 660 |
| $Fe_{65}Ni_7Co_7B_{21}$ | | | 465 |
| $Fe_{65}V_{15}B_{20}$ | | | 485 |
| $Fe_{64}Ni_{22}B_{14}$ | | 960 | 455 |
| $Fe_{63.5}Mo_{20}B_{16.5}$ | | 1325 | 640 |
| $Fe_{63}W_{19}B_{18}$ | | 1550 | 680 |
| $Fe_{60}Mo_{20}B_{20}$ | | 1325 | 640 |
| $Fe_{60}W_{20}B_{20}$ | | 1580 | |
| $Fe_{60}Co_{20}B_{20}$ | | 1100 | |
| $Fe_{60}Ni_7Co_{12}B_{21}$ | | | 472 |
| $Fe_{58}Mn_{22}B_{20}$ | | | 483 |
| $Fe_{54}Ni_{32}B_{14}$ | | 1064 | 483 |
| $Fe_{50}Ni_{20}Co_{15}B_{15}$ | 410,000 | | 422; 458 |
| $Fe_{50}Ni_5Co_{28}B_{17}$ | | | 450; 492 |
| $Fe_{50}Co_{30}B_{20}$ | | 1100 | 493 |
| $Fe_{50}Co_{28}Ni_{15}B_{17}$ | 425,000 | | 450; 492 |
| $Fe_{50}Ni_{30}B_{20}$ | 374,000 | | |
| $Fe_{50}Ni_{36}B_{14}$ | | 930 | 457 |
| $Fe_{40}Ni_{15}Co_{25}B_{20}$ | | | 473 |
| $Fe_{40}Co_{40}B_{20}$ | | 1100 | 492 |
| Cobalt Base | | | |
| $Co_{70}Fe_{10}B_{20}$ | | 1100 | 483 |
| $Co_{68}Fe_{7.5}Ni_{7.5}B_{17}$ | | | 432 |
| $Co_{60}Fe_{20}B_{20}$ | | 1100 | 483 |
| $Co_{60}Fe_{13}Ni_{10}B_{17}$ | | | 442 |
| $Co_{50}Fe_{18}Ni_{15}B_{17}$ | 370,000 | | 437; 450 |

TABLE II-continued

| Alloy Composition (atom percent) | Ultimate Tensile Strength (psi) | Hardness ($Kg/mm^2$) | Crystallization Temperature (°C.) |
|---|---|---|---|
| $Co_{40}Fe_{20}Ni_{17}B_{23}$ | | | 462 |
| Nickel Base | | | |
| $Ni_{70}Fe_{12}B_{18}$ | | | 435 |
| $Ni_{65}V_{15}B_{20}$ | | | 505 |
| $Ni_{60}Fe_{22}B_{18}$ | | | 444 |
| $Ni_{60}Fe_{13}Co_{10}B_{17}$ | | | 373 |
| $Ni_{58}Mn_{20}B_{22}$ | | | 517 |
| $Ni_{50}Fe_{32}B_{18}$ | | | 456 |
| $Ni_{50}Fe_{18}Co_{15}B_{17}$ | | | 405 |
| $Ni_{40}Fe_{20}Co_{23}B_{17}$ | | | 423 |

EXAMPLE 2

The magnetic properties of compositions found to be useful in magnetic applications are given in Table III. These properties include the saturation induction ($B_s$) in KGauss (at room temperature unless otherwise specified) and the coercivity ($H_c$) in Oe of a strip under DC conditions.

TABLE III

| Alloy composition (Atom Percent) | | Saturation Induction (KGauss) | Coercivity (Oe) |
|---|---|---|---|
| Fe—Co—B: | | | |
| | $Fe_{80}Co_5B_{15}$ | 15.6 | |
| | $Fe_{70}Co_{10}B_{20}$ | 16.5 | 0.04 |
| | $Fe_{69}Co_{18}B_{13}$ | 19 | 0.10 |
| | $Fe_{60}Co_{20}B_{20}$ | 16.4 | |
| | $Fe_{50}Co_{30}B_{20}$ | 15.7 | |
| | $Fe_{40}Co_{40}B_{20}$ | 15.0 | |
| Fe—Ni—B: | | | |
| | $Fe_{70}Ni_{10}B_{20}$ | 15.1 | |
| | $Fe_{67}Ni_{19}B_{14}$ | 18.2 (4.2 K) | |
| | $Fe_{64}Ni_{22}B_{14}$ | 17.3 (4.2 K) | |
| | $Fe_{61}Ni_{25}B_{14}$ | 17.1 (4.2 K) | |
| | $Fe_{60}Ni_{20}B_{20}$ | 14.2 | |
| | $Fe_{59}Ni_{27}B_{14}$ | 16.6 (4.2 K) | |
| | $Fe_{57}Ni_{29}B_{14}$ | 16.1 (4.2 K) | |
| | $Fe_{54}Ni_{32}B_{14}$ | 15.6 (4.2 K) | |
| | $Fe_{50}Ni_{36}B_{14}$ | 14.7 (4.2 K) | |
| | $Fe_{50}Ni_{30}B_{20}$ | 13.2 | |
| | $Fe_{40}Ni_{40}B_{20}$ | 10.8 | |
| | $Fe_{43}Ni_{43}B_{14}$ | 13.5 (4.2 K) | |
| Co—Fe—B: | | | |
| | $Co_{70}Fe_{10}B_{20}$ | 12.4 | |
| | $Co_{60}Fe_{20}B_{20}$ | 13.1 | |
| | $Co_{50}Fe_{30}B_{20}$ | 14.3 | |
| Ni—Fe—B: | | | |

TABLE III-continued

| Alloy composition (Atom Percent) | | Saturation Induction (KGauss) | Coercivity (Oe) |
|---|---|---|---|
| | $Ni_{60}Fe_{20}B_{20}$ | 5.8 | |
| | $Ni_{60}Fe_{22}B_{18}$ | | 0.059 |
| | $Ni_{50}Fe_{30}B_{20}$ | 8.1 | |
| | $Ni_{50}Fe_{32}B_{18}$ | | 0.029 |
| Fe—Co—Ni—B: | | | |
| | $Fe_{81}Co_3Ni_1B_{15}$ | 15.1 | |
| | $Fe_{70}Co_{7.5}Ni_{7.5}B_{15}$ | 13.7 | |
| | $Fe_{65}Co_7Ni_7B_{21}$ | 13.45 | |
| | $Fe_{50}Co_{15}Ni_{20}B_{15}$ | | 0.038 |

An alloy having the composition $Fe_{69}Co_{18}B_{13}$ evidenced a saturation induction (room temperature) of 19 KGauss, a coercivity of 0.16 Oe and a remanence of 8.1 kGauss. Upon annealing at 275° C., the coercivity dropped to 0.14 Oe and the remanence increased to 14.6 KGauss.

What is claimed is:

1. A primarily glassy alloy consisting essentially of the composition $M_aM'_bM''_cB_d$, where M is one element selected from the group consisting of iron, cobalt and nickel, M' is one or two elements selected from the group consisting of iron, cobalt and nickel other than M, M'' is at least one element selected from the group consisting of vanadium, manganese molybdenum, tungsten, niobium and tantalum, "a" ranges from about 40 to 85 atom percent, "b" ranges from 0 to about 45 atom percent, "c" ranges from 0 to about 20 atom percent and "d" ranges from about 26 to 28 atom percent, with the proviso that "b" and "c" cannot all be zero simultaneously.

2. The glassy alloy of claim 1 which is substantially totally glassy.

3. The glassy alloy of claim 1 in which M'' is one of molybdenum, present in an amount ranging from about 0.4 to 18 atom percent, tungsten, present in an amount ranging from about 0.4 to 15 atom percent, niobium, present in an amount ranging from about 0.5 to 12 atom percent, or tantalum, present in an amount ranging from about 0.5 to 12 atom percent.

4. The glassy alloy of claim 3 in which M'' is one of molybdenum or tungsten.

5. The glassy alloy of claim 1 in which M'' is one of manganese, present in an amount ranging from about 0.2 to 2 atom percent, or vanadium, present in an amount ranging from about 0.2 to 2 atom percent.

6. The glassy alloy of claim 1 in which M is iron.

7. The glassy alloy of claim 1 consisting essentially of a composition selected from the group consisting of, $Fe_{68}Mo_4B_{28}$, $Fe_{71}W_2B_{27}$, $Fe_{70}Mo_2B_{28}$, $Fe_{67}Mo_7B_{26}$.

* * * * *